US005172795A

United States Patent [19]

Riceman

[11] Patent Number: 5,172,795

[45] Date of Patent: Dec. 22, 1992

[54] PROTECTIVE COVER FOR HANDLED CARRYING CONTAINER

[75] Inventor: Robert G. Riceman, West Caldwell, N.J.

[73] Assignee: Randolph-Rand Corporation, New York, N.Y.

[21] Appl. No.: 571,098

[22] Filed: Aug. 21, 1990

[51] Int. Cl.[5] ..... A45C 11/00; A45C 13/00

[52] U.S. Cl. ..... 190/26; 150/105; 150/154

[58] Field of Search ..... 190/26, 125, 100; 150/104, 105, 154; 383/111, 901

[56] References Cited

U.S. PATENT DOCUMENTS

| | | | |
|---|---|---|---|
| 2,051,092 | 8/1936 | Landis | 150/105 |
| 2,432,365 | 12/1947 | Allen | 150/154 X |
| 2,487,596 | 11/1949 | Sackstein | 190/26 |
| 2,520,250 | 8/1950 | Meyers | 190/26 X |
| 2,617,504 | 11/1952 | Meyers | 190/26 |
| 2,654,453 | 10/1953 | Duskin | 190/26 |
| 2,693,259 | 11/1954 | Amick | 190/26 |
| 2,711,234 | 6/1955 | Rubens | 190/26 |
| 2,985,212 | 5/1961 | Dozier | 150/159 |
| 3,349,982 | 10/1967 | Skinner | 150/154 |
| 4,026,339 | 5/1977 | Burke | 150/106 X |

FOREIGN PATENT DOCUMENTS

| | | | |
|---|---|---|---|
| 1021817 | 2/1953 | France | 150/103 |
| 1038915 | 10/1953 | France | 150/154 |
| 2537516 | 6/1984 | France | 150/154 |
| 2147497 | 5/1985 | United Kingdom | 190/100 |
| 2617656 | 6/1986 | United Kingdom | 190/26 |

*Primary Examiner*—Sue A. Weaver
*Attorney, Agent, or Firm*—Wenderoth, Lind & Ponack

[57] ABSTRACT

A protective cover for a handled carrying container is constituted by a pair of opposed side walls having a size greater than the corresponding walls of the carrying container and having top, side and bottom edges, the top edges and the side edges of the respective side walls being joined to each other, the bottom edges being unjoined. A handle receving aperture is provided where the top edges are joined. A handle engaging sleeve or elastic collar is provided around the handle receiving aperture for engaging a container handle in substantially watertight engagement.

11 Claims, 5 Drawing Sheets

PROTECTIVE COVER FOR HANDLED CARRYING CONTAINER

The present invention relates to a protective cover for a handled carrying container, and more particularly to such a protective cover which is waterproof for protecting the carrying container against rain and the like.

BACKGROUND OF THE INVENTION

It is often necessary for persons to carry handled carrying containers, such as briefcases, suitcases, pocketbooks and the like, to move around in the outdoors in inclement weather, particularly rainy or snowy weather. During such movement, containers which are being carried frequently become wet. For such carrying containers which are made of fine and often expensive materials, such as leather, fine fabric and the like, becoming wet can damage the carrying container and cause deterioration both of the physical structure and the appearance.

It is therefore desirable to have some means for protecting such carrying containers against rain, snow and the like when they are being carried outdoors during inclement weather.

Efforts have been made to provide such a protective cover, but because of drawbacks inherent therein, they have not met with acceptance in the art. For example, in U.S. Pat. No. 2,432,365 there is disclosed a luggage cover, but it is a fitted cover which has a zipper closure along a lower front edge and either two laterally open side slots for two side-attached handles, or a single top slot closed by zippers which move toward each other to engage against the ends of a single top handle. The protective cover is difficult and time-consuming to apply, and will not keep precipitation away from the container very well. A somewhat less complicated cover is shown in U.S. Pat. No. 3,349,992, which is a sort of sleeve which fits over a shopping bag. However, the slots for the bag handles are closed only by a simple flap, which will not exclude precipitation satisfactorily.

OBJECT AND BRIEF SUMMARY OF THE INVENTION

It is therefore an object of the present invention to provide a protective cover for such handled carrying containers to protect such containers from the elements when they are being carried outdoors during inclement weather.

It is a further object of the invention to provide such a protective cover which is inexpensive, and which is easily placed on the handled carrying container, and which has handle engaging means which can engage the handle of the carrying container in such a way as to substantially prevent precipitation from reaching the body of the carrying container.

To this end, the protective cover according to the present invention has a pair of opposed side walls having a size greater than the corresponding walls of the carrying container, the top edges and the side edges of the respective side walls being permanently joined to each other, with the bottom edges being unjoined. A handle receiving aperture is provided along the top edges of the side walls, and handle engaging means is provided around the handle receiving aperture for engaging a container handle in substantially watertight engagement.

BRIEF DESCRIPTION OF THE DRAWINGS

Other and further objects will become apparent from the following specification, taken together with the attached drawings, in which.

DETAILED DESCRIPTION OF THE INVENTION

Figure 1:
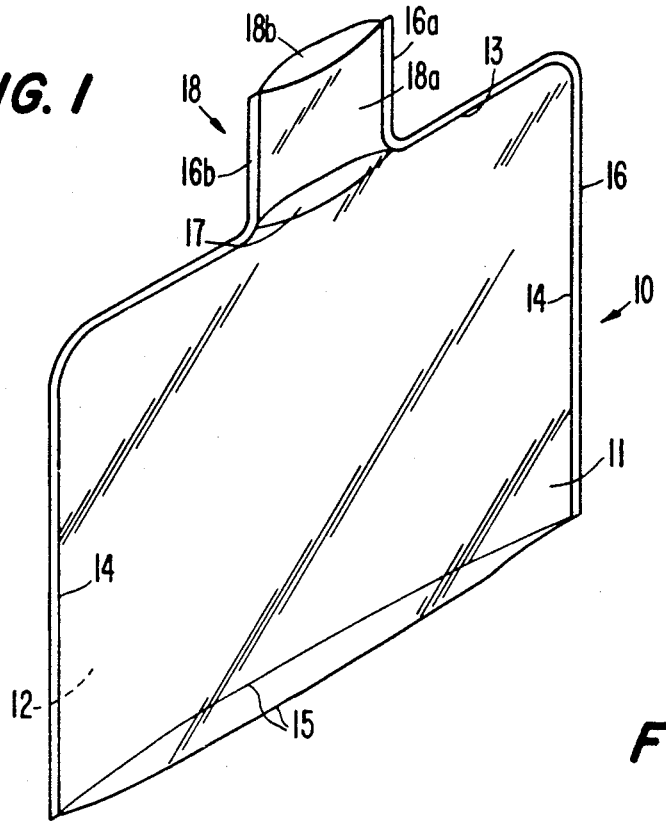
FIG. 1 is a perspective view of a first embodiment of the protective cover according to the present invention.
Figure 2:
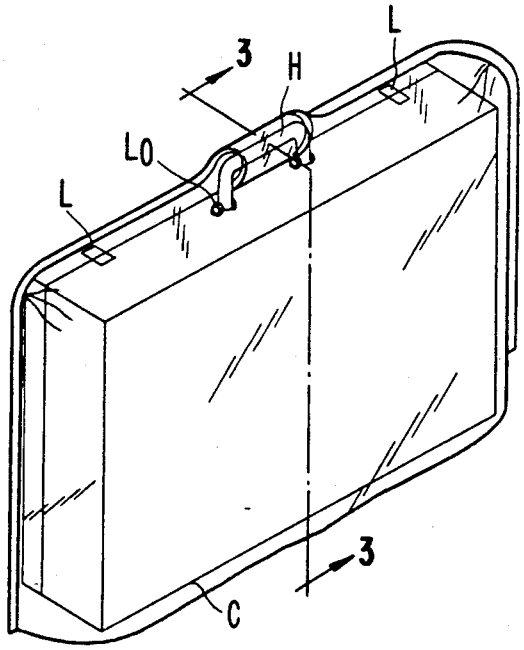
FIG. 2 is a perspective view of a briefcase-type carrying container with the protective cover of FIG. 1 in position thereon.
Figure 3:
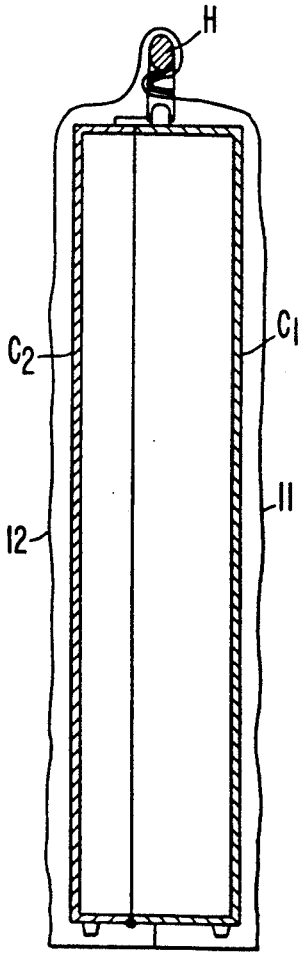
FIG. 3 is a section taken along section line 3—3 of FIG. 2.

The protective cover according to the present invention is for use in protecting a handled carrying container. Such handled carrying containers can include briefcases, suitcases, pocketbooks, shopping bags and the like. Although the invention will be described in connection with a so-called attache-type briefcase, it will be understood that it is applicable to any handled carrying container.

As shown in the drawings, the briefcase C has upper and lower halves C1 and C2 hinged to each other in a conventional manner with latches L for holding the halves together with the briefcase in the closed condition. On one of the halves is provided an arched-type stiff handle H which is normally attached to the container by attaching loops $L_O$ at the opposite ends, or similar attaching means. When the carrying container is being carried, the handle normally is projecting upwardly from the face of the carrying container, suspended from the hand of the person carrying the container with the fingers of the hand around the handle.

The first embodiment of the protective cover according to the present invention is shown in FIGS. 1–4, and comprises an envelope-type protective cover 10 which has a pair of opposed side walls 11 and 12 which have a size greater than the corresponding walls of the carrying container C, and which have top edges 13, side edges 14 and bottom edges 15. In this embodiment, means is provided which permanently join the top edges 13 and the side edges 14 of the respective side walls to each other. In this embodiment, this means is in the form of a seam 16 which extends along the top edges 13 and down along the side edges 14. The bottom edges 15 are unjoined.

The joining means has a handle receiving aperture 17 where said means join the top edges 13, and in the first embodiment this takes the form of a discontinuity in the seam 16 which is roughly the size of the handle H of the carrying container.

Handle engaging means is provided around the handle receiving aperture 17 for engaging a container handle H in substantially watertight engagement. In the first embodiment, this handle engaging means is constituted by an upwardly extending oval cross-section sleeve 18 which is open at the top. In this embodiment, the oval sleeve is formed by two extensions 18*a* and 18*b* on the respective side walls 11 and 12, which are joined together by extensions 16*a* and 16*b* of the seam 16. The sleeve 18 is sufficiently long to enable it to be wrapped around the handle of the carrying container, as described hereinbelow.

It will thus be seen that the protective cover can be easily and inexpensively manufactured by simply cutting two side walls 11 and 12 with the extensions 18*a* and 18*b* thereon out of a sheet of appropriate material, and joining them by the seam 16 with the extensions 16*a* and 16*b*.

The protective cover can be made of any appropriate material which will function to protect the carrying case onto which the protective cover is to be placed. However, especially for making the cover waterproof, it is preferred to make it of plastic, which can be either clear or opaque. In the embodiment as shown in FIGS. 1–4*c*, the material is a clear plastic material through which the carrying container can be seen.

In use, the protective cover is first expanded by moving the unjoined bottom edges 15 away from each other, and then slipping the protective cover downwardly over the carrying container until the handle H is received in the sleeve 18. The handle will then be positioned as shown in FIG. 4*a* within the sleeve 18, with the tubular sleeve projecting upwardly past the top surface of the handle H.

Figure 4A:
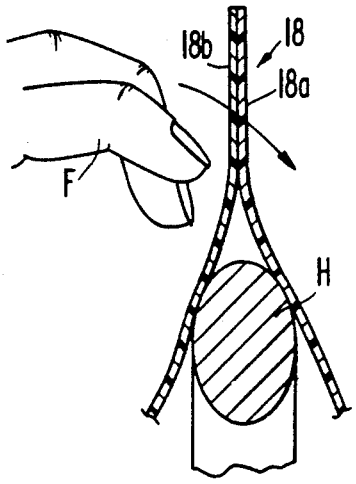
FIGS. 4*a*–4*c* are views of successive positions of the handle engaging means of the embodiment of FIG. 1 as it is wrapped around the handle of the carrying container.
Figure 4B:
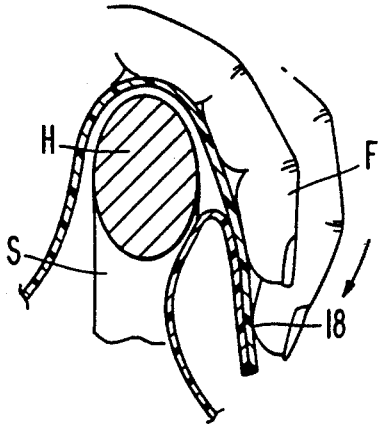
Figure 4C:
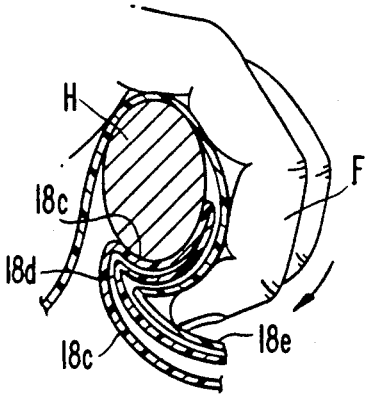

In order to complete the engagement of the handle engaging means with the handle, the upwardly projecting portion of the sleeve 18 is urged laterally thereof by the fingers F of the hand of the user, shown schematically in FIGS. 4*a*–4*c*, to the position in FIG. 4*b*, at which point the sleeve 18 has been folded downwardly so that the extremity of the sleeve 18 extends past the space S beneath the handle. Finally, the user urges the downwardly extending extremity of the sleeve 18 back under the handle H, as shown in FIG. 4*c*, so as to form a triple fold of the sleeve 18 around the handle H. It will be seen that in the space beneath the handle, there is a first fold 18*c* consisting of two layers of material against the bottom of the handle, a second fold 18*d* consisting to two layers directly under the first fold with the crease in the fold against the bent sheets of the first fold 18*c*, and a third fold 18*e* also consisting of two layers, between the space where the fingers F of the user have tucked the sleeve 18 and the top of the carrying container. When the hand of the user is gripped around the handle H, the first two folds come together in substantially watertight engagement so as to prevent water from entering the interior of the protective cover and reaching the surface of the carrying container C.

It will be seen that this is an extremely simple operation, and, upon release of the hand of the person carrying the container, the sleeve 18 can be unfolded to the position of FIG. 4*a*, and the protective cover simply lifted off the carrying container C.

Thus, the relatively simple and inexpensive protective cover can be easily and readily placed on the carrying container so as to protect it from rain or snow, and the protective cover can, when protection is no longer needed, be easily and quickly removed from the container and be made ready for re-use.

Figure 5:
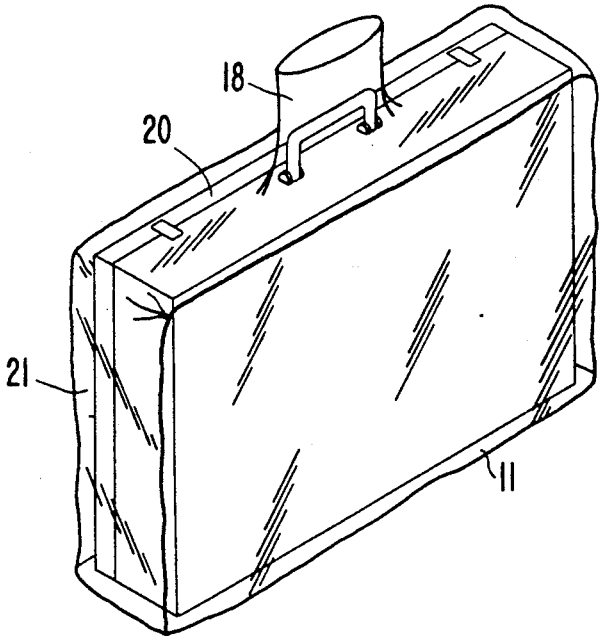
FIG. 5 is a perspective view of a second embodiment of the protective cover according to the invention in position on a briefcase-type carrying container.

The embodiment shown in FIG. 5 is substantially the same as the embodiment of FIGS. 1–4, except that the means joining the top edges and side edges of the respective side walls are a top wall 20 and end walls 21 at the opposite ends of the protective cover. Otherwise, the protective cover is the same as the cover of FIG. 1, with the sleeve 18 engagable with the handle in the same manner as shown in FIGS. 4*a*–4*c*. As with the embodiment of FIGS. 1–4*c*, the protective cover has been shown as being made of a transparent plastic material.

Figure 6:
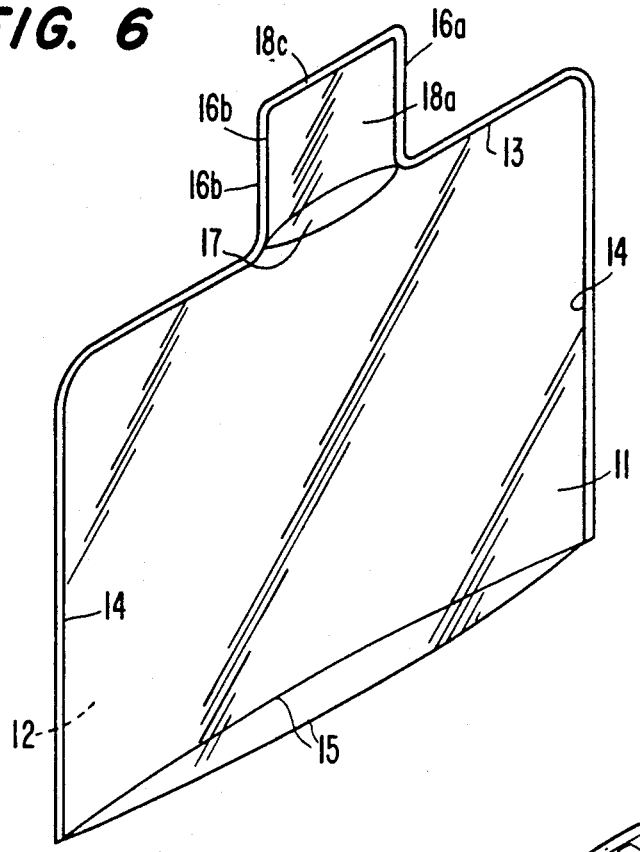
FIG. 6 is a perspective view similar to FIG. 1 showing an alternative type of handle engaging means.

A slightly modified embodiment of the embodiment of FIGS. 1–4 is shown in FIG. 6, in which the upper edges of extensions 18*a* and 18*b* are joined as at 18*c*. Otherwise, this embodiment is the same as that of FIGS. 1–4.

Figure 7:
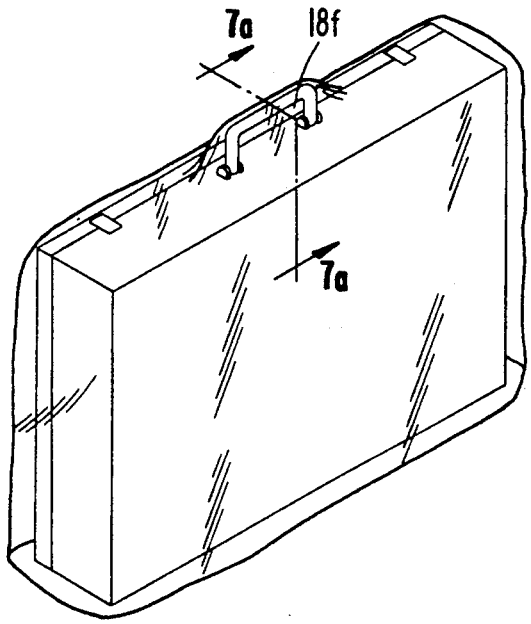
FIG. 7 is a perspective view similar to FIG. 1 showing a third embodiment of the protective cover according to the invention.
Figure 7A:
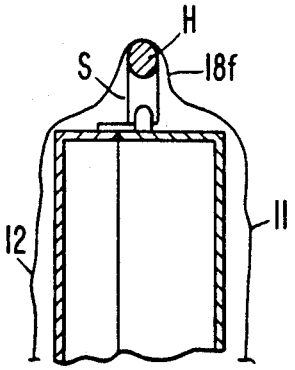
FIG. 7*a* is a section on line 7*a*–7*a* of FIG. 7.
Figure 7B:
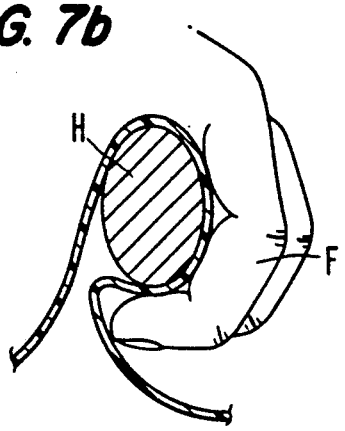
FIG. 7*b* is an enlarged view of the handled portion showing the case held by a hand.

A further modified embodiment is shown in FIGS. 7–7*b*, in which the sleeve 18 of the embodiment of FIG. 6 is increased in size so as to have excess material 18*f* sufficient to leave spaces S between the side walls of the sleeve formed by extensions 18*a* and 18*b* and the handle H when the closed top of the sleeve rests on the handle H, as shown in FIG. 7*a*. As a result, there is sufficient material in the sleeve so that the fingers F urge only a single thickness of material under and around the handle, as shown in FIG. 7*b*.

Figure 8:
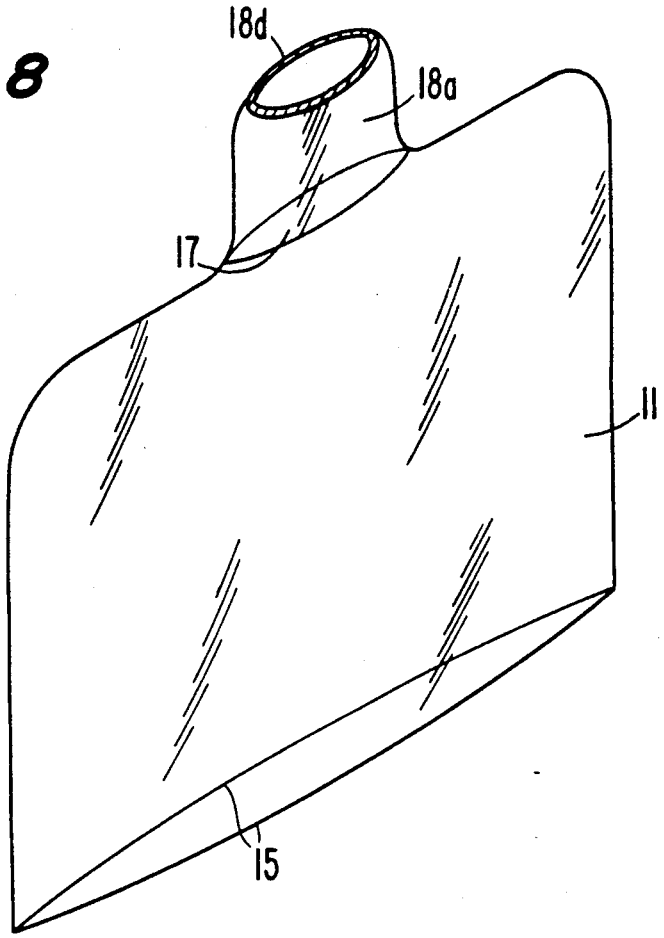
FIG. 8 is a perspective view similar to FIG. 1 showing a fourth embodiment of the protective cover according to the invention.
Figure 8A:
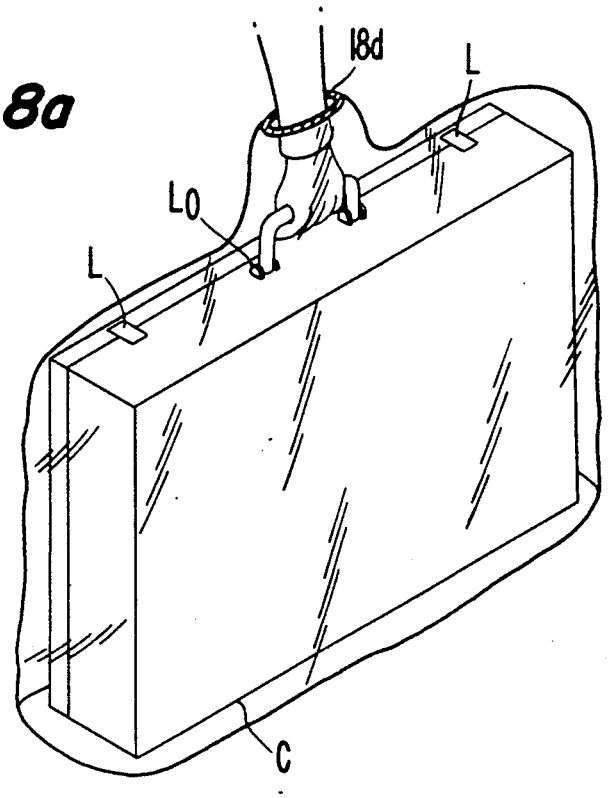
FIG. 8*a* is a perspective view of the cover of FIG. 8 in position on a carrying container and being held by a hand.

The embodiment of FIGS. 8 and 8*a* is a modified form of the embodiment of FIGS. 1–4, in which an elastic collar 18*d* is provided around the open top of the sleeve 18. With this arrangement the cover can be used either by wrapping the sleeve around the handle H, as described in connection with FIGS. 1–4, or, as shown in FIG. 8*a*, the hand and wrist of the user can be inserted through the sleeve 18 with the hand gripping the handle H in the normal manner and the elastic collar 18*d* tightly engaging around the wrist to seal out precipitation. Moreover, in this embodiment, the two side walls, instead of being joined by the joining means in the form of the seam 16, are simply heat sealed together along line 16*a*, or are integrally joined by being extruded or molded as a single unit. Needless to say, the same type of joining can be used in the other embodiments when they are made of a heat sealable, extrudable or molded material.

Figure 9:
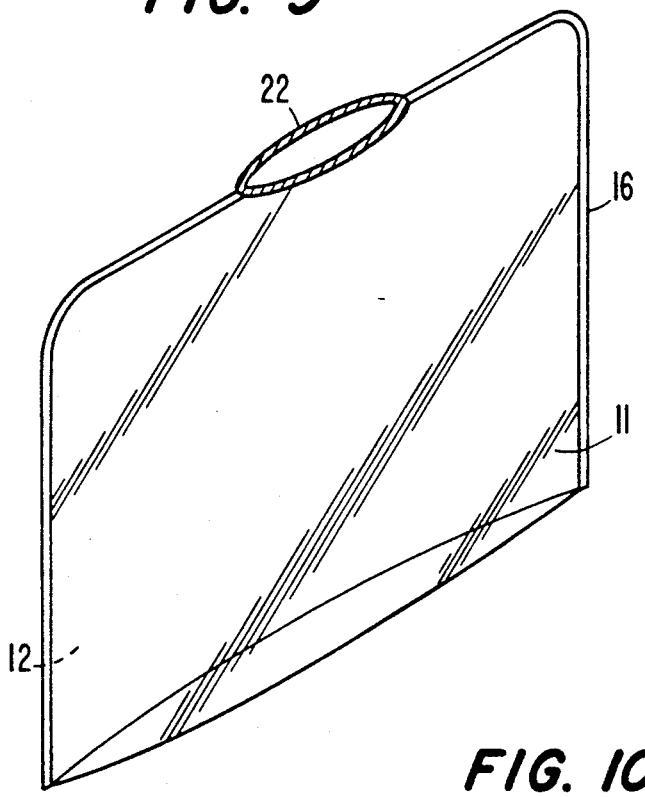
FIG. 9 is a perspective view similar to FIG. 1 showing a fifth embodiment of the protective cover according to the invention.

The embodiment of FIG. 9 shows an alternative handle engaging means, which is an elastic collar 22, like the elastic collar 18*d* of FIGS. 8 and 8*a*, around the opening 17 in the top of the protective cover. The size of the elastic collar is such that, when the protective cover is drawn downwardly over the carrying container, the elastic collar engages tightly around the base of the handle H where it is attached to the top of the carrying container C, in substantially watertight engagement. Naturally, the engagement is not as watertight as the engagement of the sleeve 18 in the embodiment of FIGS. 1–4, 5, 6, 7 or 8*a*, 8*b*, but for some purposes, a lesser watertight engagement may be satisfactory.

Figure 10:
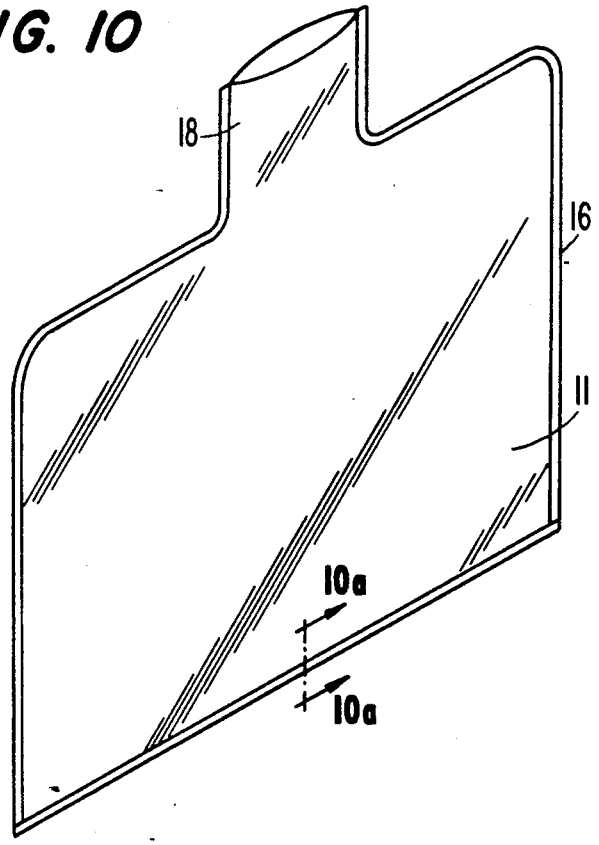
FIG. 10 is a perspective view of a sixth embodiment of the protective cover according to the invention including a sealing means along the bottom edges of the container.
Figure 10A:
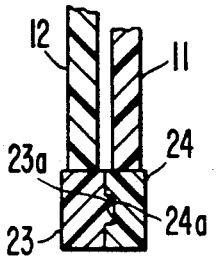
FIG. 10*a* is a section taken along section line 10*a*–10*a* of FIG. 10.

In the embodiments of FIGS. 1–9, the bottom of the protective cover is open, the bottom edges of the opposed side walls being unjoined. Under some circumstances, it may be desirable to provide means for separably joining the bottom edges, and one example of such means is shown in the embodiment of FIG. 10. The embodiment of FIG. 10 is the same as that of FIG. 1, but in addition, there is provided along the bottom edges of the opposed side walls 11 and 12 a first sealing member 23 having a projecting flange 23*a* and a second sealing member 24 having a groove 24*a* for receiving the flange 23*a* in a frictional fit. By inserting the flange 23*a* into the groove 24*a* along the entire length of the bottom edges of the opposed side walls 11 and 12, the bottom edges can be sealed to each other for completely enclosing the carrying case within the protective cover.

It will thus be seen that there has been provided a protective cover for a handled carrying container which has a simple construction and is inexpensive to manufacture, and yet which can be easily and quickly fitted over a handled carrying container to protect it from rain and snow and the like, and yet which can be quickly and easily removed and reused.

While the invention has been disclosed in the form of several different embodiments, it will be understood that other and various constructions which are the equivalent of those shown can be provided, which are within the scope of the present invention, and the invention is to be limited only by the appended claims.

What is claimed is:

1. A protective cover for a carrying container having an arched-type stiff handle, having opposite ends attached to the container and around which the fingers of a hand can be gripped, comprising:

a pair of opposed side walls having a size greater than the corresponding walls of the carrying container and having top, side and bottom edges, said top edges and side edges of the respective side walls including means for permanently joining said edges to each other, the bottom edges being unjoined, said protective cover having a handle receiving aperture where said top edges are joined; and handle engaging means around said handle receiving aperture and engageable around and under the arched-type handle in substantially watertight engagement, said handle engaging means being an upwardly extending sleeve integrally joined to said side walls and into which the handle extends, the upper end of said sleeve being open and dimensioned for permitting insertion of a hand.

2. A protective cover as claimed in claim 1, further comprising an elastic collar around said open upper end of said sleeve, said collar being dimensioned for engaging around the wrist of an inserted hand.

3. A protective cover as claimed in claim 1 in which said joining means is a seam.

4. A protective cover as claimed in claim 1 in which said joining means is a top wall joining the top edges of the respective side walls and end walls joining the side edges of the respective side walls.

5. A protective cover as claimed in claim 1 further comprising sealing means along the bottom edges of said side walls for separably sealing said bottom edges to each other.

6. A protective cover as claimed in claim 1, wherein said sleeve has a sufficient length for being capable of being wrapped around the handle in watertight engagement therewith.

7. A protective cover for a carrying container having an arched-type stiff handle having opposite ends attached to the container, comprising:

a pair of opposed side walls having a size greater than the corresponding walls of the carrying container and having top, side and bottom edges, said top edges and side edges of the respective side walls including means for permanently joining said edges to each other, the bottom edges being unjoined, said protective cover having a handle receiving aperture where said top edges are joined, and an elastic collar around said handle receiving aperture being dimensioned for tight engagement around the opposite ends of the container handle where they are attached to the container.

8. A protective cover for a carrying container having an arched-type stiff handle, having opposite ends attached to the container and around which the fingers of a hand can be gripped, comprising:

a pair of opposed side walls having a size greater than the corresponding walls of the carrying container and having top, side and bottom edges, said top edges and side edges of the respective side walls being integrally joined to each other, the bottom edges being unjoined, said protective cover having a handle receiving aperture where said top edges are joined; and handle engaging means around said handle receiving aperture and engageable around and under the arched-type handle in substantially watertight engagement, said handle engaging means being an upwardly extending sleeve integrally joined to said side walls and into which the handle extends, the upper end of said sleeve being open and dimensioned for permitting insertion of a hand.

9. A protective cover as claimed in claim 8, further comprising an elastic collar around said open upper end of said sleeve, said collar being dimensioned for engaging around the wrist of an inserted hand.

10. A protective cover as claimed in claim 8, wherein said sleeve has a sufficient length for being capable of being wrapped around the handle in watertight engagement therewith.

11. A protective cover for a carrying container having an arched-type stiff handle, having opposite ends attached to the container, comprising:

a pair of opposed side walls having a size greater than the corresponding walls of the carrying container and having top, side and bottom edges, said top edges and side edges of the respective side walls being integrally joined to each other, the bottom edges being unjoined, said protective cover having a handle receiving aperture where said top edges are joined, and an elastic collar around said handle receiving aperture being dimensioned for tight engagement around the opposite ends of the container handle where they are attached to the container.

* * * * *